United States Patent [19]

Pike

[11] Patent Number: 4,869,181

[45] Date of Patent: Sep. 26, 1989

[54] METHOD AND APPARATUS FOR INCORPORATING INCANDESCENT FILTER FOR PRODUCTS OF COMBUSTION OF FURNACE

[76] Inventor: Clinton B. Pike, 2 Willow Rd., No. 19, Menlo Park, Calif. 94025

[21] Appl. No.: 151,701

[22] Filed: Feb. 3, 1988

[51] Int. Cl.[4] ..... F23G 5/00

[52] U.S. Cl. ..... 110/211; 110/214; 110/234; 110/254; 110/309

[58] Field of Search ..... 110/203, 208, 210, 211, 110/214, 216, 229, 230, 233–235, 344–345, 254, 257, 301–302, 308–309, 314; 122/15, 22, 155 R, 157, 166 R, 168, 235.1

[56] References Cited

U.S. PATENT DOCUMENTS

| | | | |
|---|---|---|---|
| 1,283,668 | 11/1918 | Cherry | 110/297 X |
| 1,594,127 | 7/1926 | Slater et al. | 110/234 |
| 1,795,771 | 3/1931 | Golovtchikoff | 110/235 |
| 2,295,781 | 9/1942 | Fellows et al. | 110/230 |
| 3,277,945 | 10/1966 | Vesmes | 110/230 X |
| 3,610,179 | 10/1971 | Shaw, Jr. | 110/214 |
| 3,877,440 | 4/1975 | Winkin | 110/309 X |
| 4,102,279 | 7/1978 | Greschl et al. | 110/254 X |
| 4,436,756 | 3/1984 | Chamberlain et al. | 110/254 |

*Primary Examiner*—Henry C. Yuen
*Attorney, Agent, or Firm*—John J. Leavitt

[57] ABSTRACT

Presented is a method and apparatus for incorporating an incandescent filter for products of combustion in the combustion chamber of a furnace including a grate and an exit slot for products of combustion located above the level of the grate. Incandescent coals from the fuel being burned obstruct the exit slot, and products of combustion must pass through the incandescent coals. In one aspect, water tubes line the walls of the combustion chamber, primary combustion air is admitted between the tubes, and the admission of secondary air is controlled to maintain an incandescent bed of coals through which products of combustion must be drawn to exit the furnace. In another aspect, a reciprocating grate is provided, and primary combustion air penetrates the bed of fuel from below. Products of combustion pass back through a portion of the burning fuel maintained at incandescence by the admission of secondary air upwardly through the reciprocating grate. In yet another aspect, low ash or no ash fuel is placed on top of a bed of crushed fire brick supported on a grate through which primary combustion air passes upwardly. Carbon particles from primary combustion collect on the crushed fire brick, and are ignited to form a relatively thick bed of incandescent material to oxidize products of combustion emanating from the primary combustion zone.

22 Claims, 13 Drawing Sheets

METHOD AND APPARATUS FOR INCORPORATING INCANDESCENT FILTER FOR PRODUCTS OF COMBUSTION OF FURNACE

BACKGROUND OF THE INVENTION

1. Field of the Invention

This invention relates to furnaces, and particularly to the method and apparatus in a furnace for effectively incorporating an incandescent filter through which the products of combustion of the furnace must pass to convert such products of combustion into harmless non-toxic vapors.

2. Description of the Prior Art

A search for prior art in connection with this invention has been conducted in the following classes and sub-classes:

Class 126 and sub-classes 58, 67, 69, 75, 76, 103, 108, 110AA, 112, 152R, 193, 225;

Class 110 and sub-classes 208, 209, 214, 236, 309, 315;

Class 122 and sub-classes 162 and 204.

As a result of the search in the area indicated, and in reviewing the prior art in the form of patents that have been issued to companies that are active in the industry of manufacturing furnaces, and through a review of literature purchased through the National Technical Information Service of the United States Government, sixty patents are known to exist as follows:

| | | | | | |
|---|---|---|---|---|---|
| 91,821 | 698,800 | 698,810 | 2,295,781 | 3,874,362 | 4,201,141 |
| 208,221 | 698,801 | 843,103 | 2,461,068 | 3,937,154 | 4,203,374 |
| 503,817 | 698,802 | 843,104 | 2,481,164 | 4,044,820 | 4,285,328 |
| 518,576 | 698,803 | 843,105 | 2,481,165 | 4,063,521 | 4,354,440 |
| 628,272 | 698,804 | 843,106 | 2,488,014 | 4,074,638 | 4,356,778 |
| 644,792 | 698,805 | 998,800 | 2,564,713 | 4,080,909 | 4,366,759 |
| 698,796 | 698,806 | 1,069,577 | 3,780,674 | 4,102,318 | 4,380,228 |
| 698,797 | 698,807 | 1,326,621 | 3,844,233 | 4,172,425 | 4,395,956 |
| 698,798 | 698,808 | 1,716,319 | 3,855,950 | 4,191,114 | 4,441,436 |
| 698,799 | 698,809 | 1,954,923 | 3,861,332 | 4,194,487 | 4,449,460 |
| | | | | | 4,471,753 |

The construction of stoves and furnaces, as we know them today in the form of appliances that are enclosed within a room or a building for the purpose of generating heat within that room or building, are of relatively recent origin. Historically, the term "stove" was used to define a room that was artificially heated in some way. The term was not utilized in early history to designate the device by which the room was heated.

As used today, the term "stove" is generally applicable to appliances most usually stationed and utilized in a kitchen, for purposes of heating and cooking. In most instances, stoves today are not used to provide illumination in a room, although there are exceptions to this general rule. Furnaces on the other hand, are an outgrowth of stoves, and appear to have evolved from fuel burning stoves when habitats changed from single rooms to multiple rooms and to multiple stories of rooms. In this latter case, the "stove", now stylized a "furnace", was moved into the basement of the house or habitat and was utilized through the use of appropriate fuel and grates or ducts to heat the entire house.

As our society advanced in technology, it became evident that the generation of heat was necessary to accomplish many of the technological processes that were being invented. Accordingly, the furnace as we know it today used in industrial environments evolved from the furnace that was first used to heat homes, which in turn was an outgrowth of the stove as an appliance that was used in early history for heating and cooking. History reveals to us that for many years the solid fuel burning stove, constituted almost the only type of heating appliance that was available. Through passage of time, and the discovery of natural gas, and other flammable gases and liquids, such as kerosene and oil, stoves and furnaces have evolved into more and more complex structures. For a time in recent history, the solid fuel burning stove and furnace as we know it, either for home heating or for industrial heating, has been almost replaced by oil and gas fired furnaces.

However, again because of recent history, and the increase of the price of oil and hydrocarbon type fuels, wood burning stoves and furnaces, and more broadly solid fuel type furnaces, have once again enjoyed considerable attention. However, almost coincidentally with the popularity of the solid fuel burning appliance has come the realization that the products of combustion of solid fuel appliances has a tendency to pollute the atmosphere with both visible and invisible contaminants. As a consequence, the Environmental Protection Agency in the United States has set down very specific quantitative and qualitative limits to the contaminants that may be emitted into the atmosphere by industrial and domestic stoves, furnaces, incinerators and other solid fuel burning appliances. For instance, the Department of Environmental Quality for the State of Oregon has mandated that all new wood burning stoves or fire place inserts must be certified by the State's Department of Environmental Quality. To secure certification for 1987, for instance, wood burning stoves with catalytic combusters cannot emit more than six grams of total particulates an hour. In 1988, Oregon's standards will prohibit the same stoves and inserts from emitting more than four grams per hour. The law also mandates that non-catalytic stoves must keep their emissions down to fifteen grams an hour during 1987, and nine grams per hour by 1988. By July 1, 1988, it is expected that the new regulations will provide a particulate emission ceiling for ordinary stoves at 8.5 grams per hour, decreasing to 7.5 grams per hour after July 1, 1990. For stoves fitted with catalytic combustors (a smoke afterburner that works much like an automobile's catalytic converter), particulate emissions levels would have to be as low as 5.5 grams per hour in 1988, 4.1 grams per hour by 1990.

While these regulations are apparently directed only to particulates, which generate visible emissions, it is argued that when particulate levels are reduced, so are other harmful pollutants, such as the invisible gases that normally accompany visible pollutants. Obviously, the brunt of the regulations is going to be felt by stoves and furnaces that utilize oxygen restricting devices to control burning, the result being an inefficient, smoldering fire that sends excessive levels of pollutants up the flue.

However, products of combustion are not the only kinds of pollutants that society must address. While it is extremely important that we have clean air to breathe, it is also extremely important that we have clean water to drink. In this respect, metropolitan areas have encountered increasing difficulty in finding accessible and economically feasible landfill locations for disposing of all of the garbage and refuse that is generated by their inhabitants. For instance, a great deal of effort has been expended in an attempt to find a suitable way of disposing of the garbage and refuse generated by society. One of the ways of disposing of such garbage and refuse is to burn the material and to utilize the heat from combustion to generate electricity, thus recouping the cost of manufacturing and building the necessary facilities to effect incineration of the garbage and refuse. The argument that is given by the proponents of incineration of garbage and refuse is that the landfill method of disposal pollutes the underground aquifers, thus polluting the underground water supply of society in a manner that is untenable. However, as discussed above, the problem of releasing contaminants into the atmosphere and thus polluting the air we breathe, is also an untenable circumstance that society must solve, and this is advanced by the opponents of incineration.

Accordingly, one of the objects of the present invention is to provide a furnace that burns solid fuel such as wood and coal, and even refuse and wet garbage in such a way that the products of combustion are forced to pass through an incandescent filter in such manner that the products of combustion are themselves combusted or converted into non-polluting and non-toxic emissions.

Another object of the invention is the provision of a furnace which may be modular in its concept and structure, being increased or decreased in size to satisfy the needs of the user.

A still further object of the invention is the provision of a furnace structure, particularly the combustion chamber thereof, which can burn any fuel with emissions of fly ash, nitrogen oxides and sulfur oxides and visible particulates (smoke) well within any clean air regulations.

One of the problems that has occurred in connection with forest waste products, and other combustible fuels that contain large percentages of non-combustibles such as dirt, rock and scrap metals, is that there is a tendency for the conventional furnace to be plugged by such non-combustible materials. Accordingly, it is another object of the present invention to provide a furnace that will accept large percentages of such non-combustibles in the fuel with which it is fired, without being plugged by such non-combustibles.

It frequently happens, that stoves and furnaces are designed to accommodate a particular type of fuel. Thus, gas burning or oil burning furnaces are not designed to accept solid fuel such as coal or wood or garbage or refuse. Accordingly, another object of the present invention is the provision of a furnace structure, particularly the combustion chamber thereof, which will burn all types of fuels, whether they be gases, liquids or solids with no prior processing of the fuel being required.

A still further object of the invention is the provision of a furnace which will produce combustion so efficient that no scrubbing, filtering, electrostatic or centrifugal cleaning of the flue gases is required.

It is notorious that when wet fuel is applied to a furnace or fire, a great deal of smoke results by products of combustion that are not combusted and which merely smolder. Accordingly, a still further object of this invention is the provision of a furnace which will accept dripping wet fuel and burn such dripping wet fuel at very high efficiency with no visible emissions discharged into the atmosphere.

In one aspect of the invention, it is an object to provide in a furnace a combustion chamber that is completely sealed against the escape of products of combustion therefrom except through a designated outlet, that outlet being covered within the furnace structure by an incandescent bed of coals that requires that all products of combustion pass through the incandescent bed of coals prior to reaching the exit from the firebox.

Still another object of the invention is the provision of a combustion chamber for a furnace in which the combustion chamber is lined with water-cooled tubes, the tubes on at least one wall of the combustion chamber being arranged to provide an exit for hot gases from the combustion chamber, the exit being related to the charge of fuel so that primary air is admitted to the combustion chamber above the charge of fuel, while secondary air is admitted to the combustion chamber from below the charge of fuel, thus forcing the fuel above the outlet to burn in a down draft manner while the fuel below the outlet burns in an updraft manner.

In a preferred form of the invention, particularly when solid fuel such as wood or coal is being burned, the coals formed from the burning wood or coal form a thick layer which constitutes an incandescent filter through which products of combustion must be drawn so as to fully combust any combustible particulate matter that has resulted from the initial combustion, and transform or convert harmful gases to non-toxic unharmful vapors. However, in situations where the fuel does not generally form a thick incandescent bed of coals, it is desirable nevertheless to provide an incandescent filter through which the products of combustion will nevertheless be drawn. Accordingly, it is a still further object of this invention to provide a combustion chamber for a furnace equipped with means for providing such a thick bed of incandescent carbonaceous material even though the fuel may constitute combustible material that normally does not form large coals.

The invention possesses other objects and features of advantage, some of which, with the foregoing, will be apparent from the following description and the drawings. It is to be understood however that the invention is not limited to the embodiment illustrated and described, since it may be embodied in various forms within the scope of the appended claims.

SUMMARY OF THE INVENTION

In terms of broad inclusion, the method and apparatus of the invention for incorporating an incandescent filter for the products of combustion in a furnace combustion chamber comprises a sealed housing forming the combustion chamber, the interior walls of which are lined with water-cooled tubes arranged in such a manner that fuel may be fed into the combustion chamber to rest upon a grate that is positioned within the combustion chamber at a level above the lowest tube to above an exit slot for products of combustion that is located substantially above the level of the grate. Thus, incandescent coals from the fuel are always present in front of the exit slot through which products of combustion must pass to exit the combustion chamber. Means are provided for admitting primary combustion air to the air space above the bed of fuel, thus providing necessary oxygen to the flame within the combustion chamber to efficiently maintain combustion, while means are also provided to admit secondary air to the incandescent coals that lie opposite the exit opening for products of combustion to thus maintain incandescence of such coals. In a second aspect of the invention, clusters of water-cooled tubes are disposed within the combustion chamber in such a manner that the tubes lie essentially buried within the mass of fuel but are arranged in such a manner that primary combustion air may be admitted into the combustion chamber between the tubes of selected clusters, to promote primary combustion, while other selected clusters of tubes may be positioned and valved in such a way as to control the admission of secondary air into the primary combustion zone, to thus maintain an incandescent bed of coals within the body of fuel through which products of combustion must be drawn before they are permitted to escape from the interior of the combustion chamber. In a third aspect of the invention, the furnace includes a combustion chamber having a reciprocating grate supporting a bed of combustible fuel, with a source of primary combustion air provided so as to penetrate the bed of fuel from below, thus constituting an updraft through the burning fuel to provide the necessary oxygen for combustibility thereof. The products of combustion from the primary combustion zone however are not liberated directly into the atmosphere but are instead trapped within the sealed combustion chamber and are forced to pass back through the burning fuel through a portion thereof that is maintained at incandescence by the admission of secondary air upwardly through the reciprocating grate and an additional source of secondary air admitted downwardly onto the incandescent bed whereby the incandescent bed constitutes a filter that causes combustion of all combustible particulate matter passing therethrough, and serves to convert harmful gases to unharmful vapors that may then be released into the atmosphere. Means are also provided for filtering from the products of combustion that are emitted through the flue any fly ash that may be entrained therewith. In a fourth aspect of the invention, as alluded to above, low ash or no ash fuel may sometimes be placed in a furnace and the burning of such fuel ordinarily does not generate a thick bed of incandescent coals. Accordingly, in this aspect of the invention, the low ash or no ash fuel is placed on top of a bed of crushed fire brick in the combustion chamber which is supported on an appropriate grate through which primary combustion air is blown upwardly. The smoke and fumes from this primary combustion is forced through appropriate passageways into a filter zone that is equipped with crushed fire brick where carbon particles from the primary combustion collect on the crushed fire brick, and because this layer of crushed fire brick is exposed to the extremely hot gases emanating in the primary combustion zone, the carbon particles ignite to form a relatively thick bed of incandescent material albeit such bed is partially formed from crushed fire brick, to thus oxidize any product of combustion emanating from the primary combustion zone. In this aspect of the invention, it should be noted that in addition to primary air being admitted to the combustion chamber from below the grate that supports the crushed layer of fire brick that supports the primary fuel, secondary air is also admitted to the primary combustion chamber in the region of the opening into the passageway of the smoke prior to its entrance into the incandescent filter area, thus providing sufficient oxygen to be entrained in the secondary air current to support combustion of the carbon particles on the crushed fire brick and thus create an incandescent bed through which products of combustion must be drawn before they escape to the atmosphere.

DESCRIPTION OF THE PREFERRED EMBODIMENT

Figure 1:
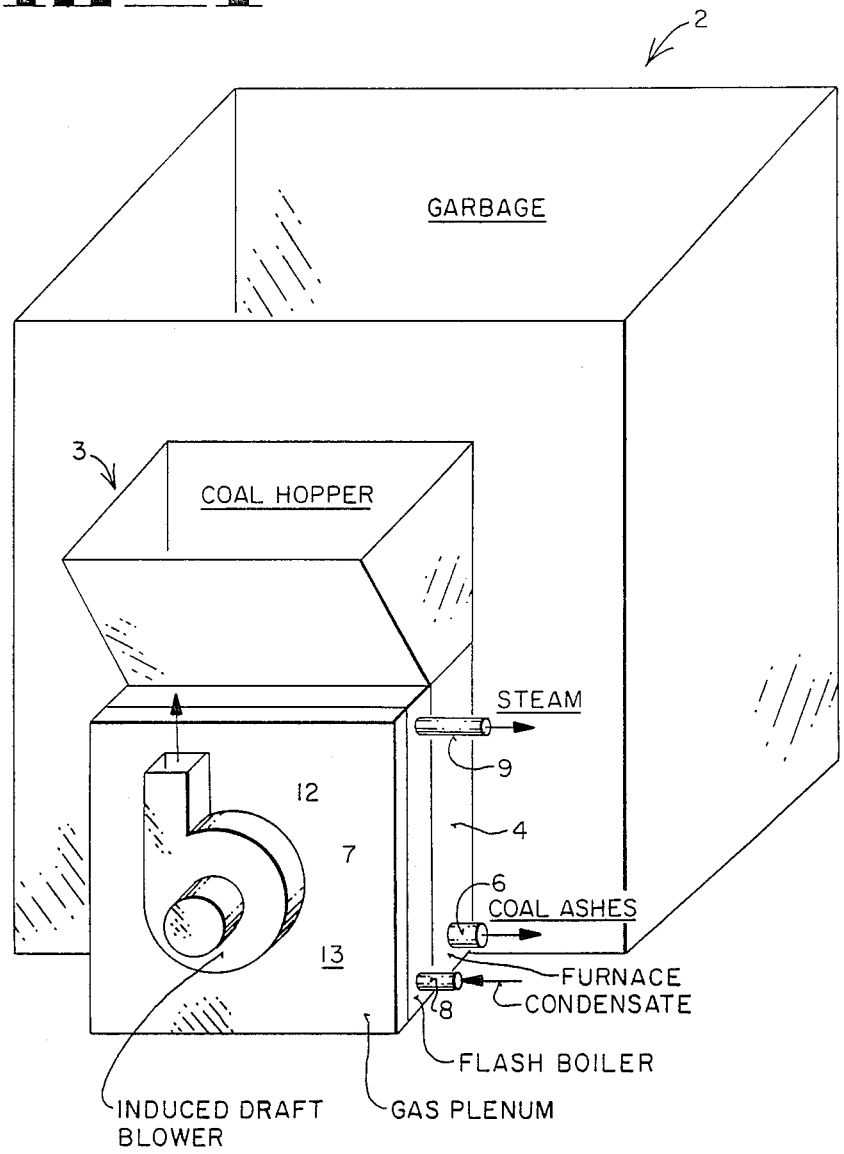
FIG. 1 is a schematic perspective view illustrating one embodiment of the furnace of my invention incorporated into a facility for incinerating garbage and refuse in conjunction with an incandescent filter formed from coal.

In terms of greater detail, the method and apparatus for incorporating an incandescent filter for products of combustion in a furnace structure is motivated by the need for preserving some of our natural resources and the desire to place in the hands of those who wish to, the ability to generate electricity without the need of depleting natural resources. Naturally potable water to drink and for cooking purposes, and clean air free from contaminants that are harmful to the human system are resources that we must protect at all costs. Air pollution in metropolitan areas at least has been blamed largely on the emissions from the exhaust of automobiles and other internal combustion engines. However, pollution of the atmosphere also occurs when a wood burning stove is ignited, when waste material from a classroom is burned in an incinerator, and when waste material from nursing homes and hospitals are burned in incinerators. A very large proportion of the pollution of the atmosphere occurs from furnaces used in industrial processes which utilize solid fuels such as wood and coal to fire the furnaces, and which do not have adequate facilities for removing contaminants from the products of combustion before they are liberated into the atmosphere. Our water resources are threatened by the monumental amount of human waste that is disposed of in metropolitan areas. Most such waste, commonly called garbage or refuse, is collected and deposited in landfill areas which may or may not be "sanitary" type landfills that meet specific requirements mandated by the legislature. For instance, in California, an inventory of all disposal sites within the state has been made to determine which are "open dumps" which do not meet federal standards, and which are "sanitary landfills" which do meet federal requirements for the disposal of waste products. Since the disposal of these waste products in the earth poses the problem of contamination of the aquifers upon which communities depend for clean potable water, it is obvious that great care must be taken to maintain sanitary landfill operations that meet the most stringent conditions. As late as 1981, with the State of California, this type of waste product was estimated to pile up relentlesly seven days a week at the rate of 3.3 pounds per person per day. Combined with waste from other sources, forty-six million tons a year were accumulated in California, enough waste to fill a freeway ten feet deep from the State of Oregon to the Mexican border.

In an effort to eliminate or at least control the degree of contamination of our aquifers it has been proposed that this large volume of waste be incinerated. Successful incineration plants have been constructed in many cities throughout California, some on an experimental basis, and others on a "waste-to-recovery" system in which an attempt is made to recoup the cost of the installation. In most of these plants, a recycling program is initiated which removes valuable materials from the waste prior to incineration.

Thus, the method and apparatus for incorporating an incandescent filter for products of combustion of furnaces as described herein is particularly applicable in all those instances where waste products are to be incinerated because the drawing of the hot gases liberated by combustion through the incandescent filter results in eliminating the harmful contaminants so that only harmless vapors are released into the atmosphere. Referring to the drawings, and particularly to the embodiment of the invention as illustrated in FIGS. 1 through 9, it will be seen that in FIG. 1 a furnace arrangement is provided that includes a garbage combustion chamber designated generally by the numeral 2, the combustion chamber being appropriately connected to a coal hopper designated generally by the numeral 3, the garbage type fuel being deposited into the garbage combustion chamber in any appropriate manner forming no part of this invention. In like manner, the coal hopper is fed with coal from an appropriate source by any desired mechanical means, or even by hand, depending upon the capacity of the furnace and the manner of its operation. In the interest of expediency, the garbage combustion chamber and coal hopper are illustrated in FIG. 1 without a cover. In practice, both these chambers would be sealed against the escape of hot gases from the combustion chamber. Both the garbage hopper and the coal hopper feed into a combustion chamber proper designated generally by the numeral 4 which is completely enclosed and receives fuel from both hoppers. Ash from the bottom of the combustion chamber 4, is removed at 6 by an appropriate means such as a screw conveyor, while hot products of combustion are passed through a flash boiler 7 which receives a condendensate such as water at 8, and discharges steam through an appropriate outlet 9, the steam being used to power an appropriate turbine, for instance, a turbine for the generation of electricity. Mounted on the furnace is a motor driven blower designated generally by the numeral 12 and which is operated and controlled to produce and to deliver the appropriate amounts of air into the furnace to support combustion. The blower 12 is appropriately connected to a gas plenum 13 as illustrated. Hot gases with unburned smoke and fumes from the burning garbage are drawn into the coal furnace where they are oxidized. The clear gases, now free of pollutants, are drawn through the flash boiler where the heat is removed by converting the condensate into steam. In this embodiment of the invention, the bed of burning coal functions as an incandescent filter through which the hot gases with unburned smoke and fumes from the garbage fuel must pass and be consumed before the hot gases exit the system.

Figure 2:
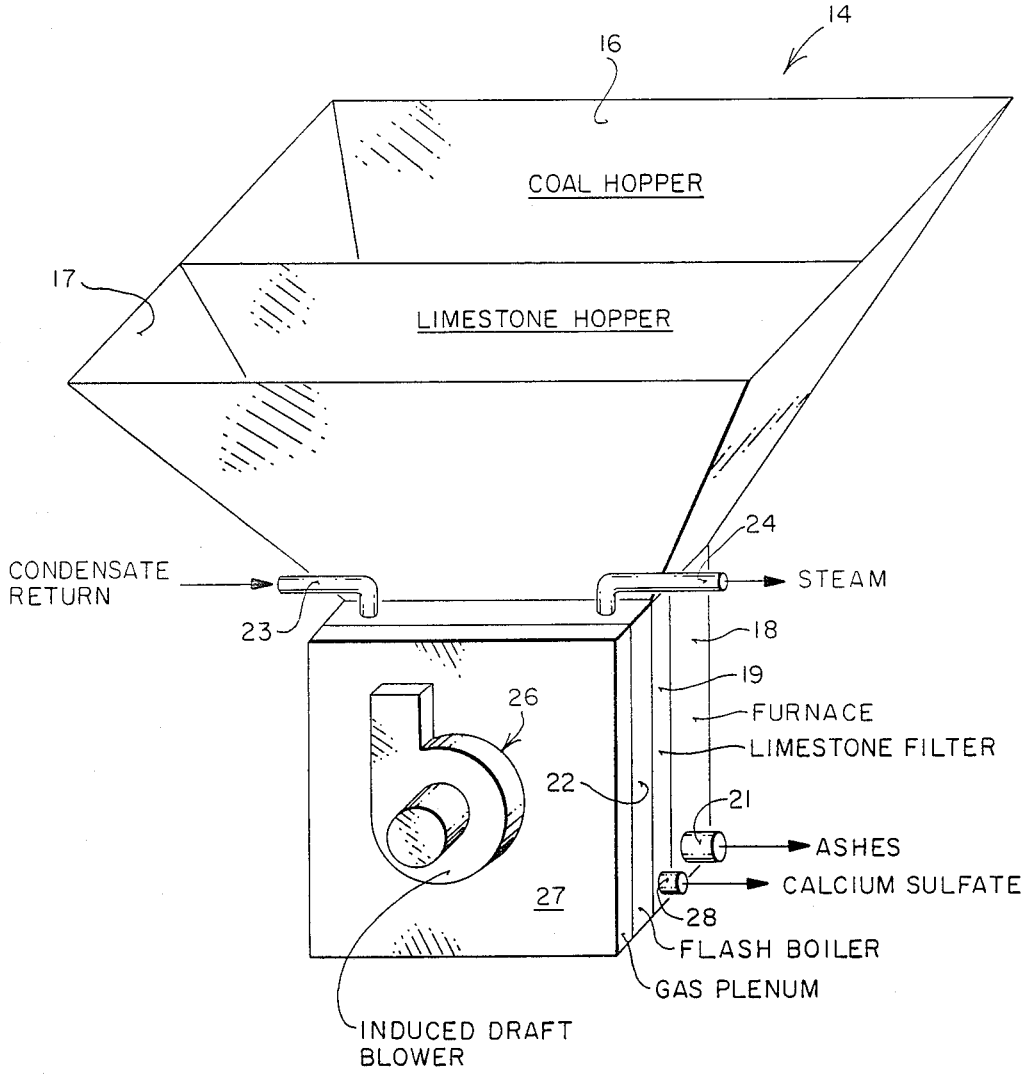
FIG. 2 is view similar to FIG. 1, but using coal for the primary fuel and limestone as the filter for the hot gases drawn from the coal furnace.

Referring to FIG. 2, there is there shown a coal furnace designated generally by the numeral 14, including a coal hopper 16 and a limestone hopper 17, the coal hopper feeding by gravity or otherwise into a furnace combustion chamber 18 operatively connected to the limestone filter 19. Operation of the furnace 18 generates ash which is removed through the outlet 21 which may conveniently be a screw conveyor that is operated automatically to maintain a predetermined level of ashes within the base of the furnace, and which removes excess ash into an appropriate receptacle (not shown). Hot gases having entrained particulates from the coal furnace are drawn through the limestone filter, where the sulphur oxides are converted, then the now clean gases are passed through the flash boiler 22 where the heat converts condensate admitted through the inlet 23 into steam discharged through the outlet 24. As with the embodiment of the invention illustrated in FIG. 1, this furnace arrangement is provided with an induced draft blower 26 operatively mounted in conjunction with a gas plenum 27. As indicated in the drawing, operation of the limestone filter, which constitutes an incandescent gate through which the products of combustion from the coal furnace must pass, generates calcium sulphate which is discharged through the outlet 28.

Figure 3:
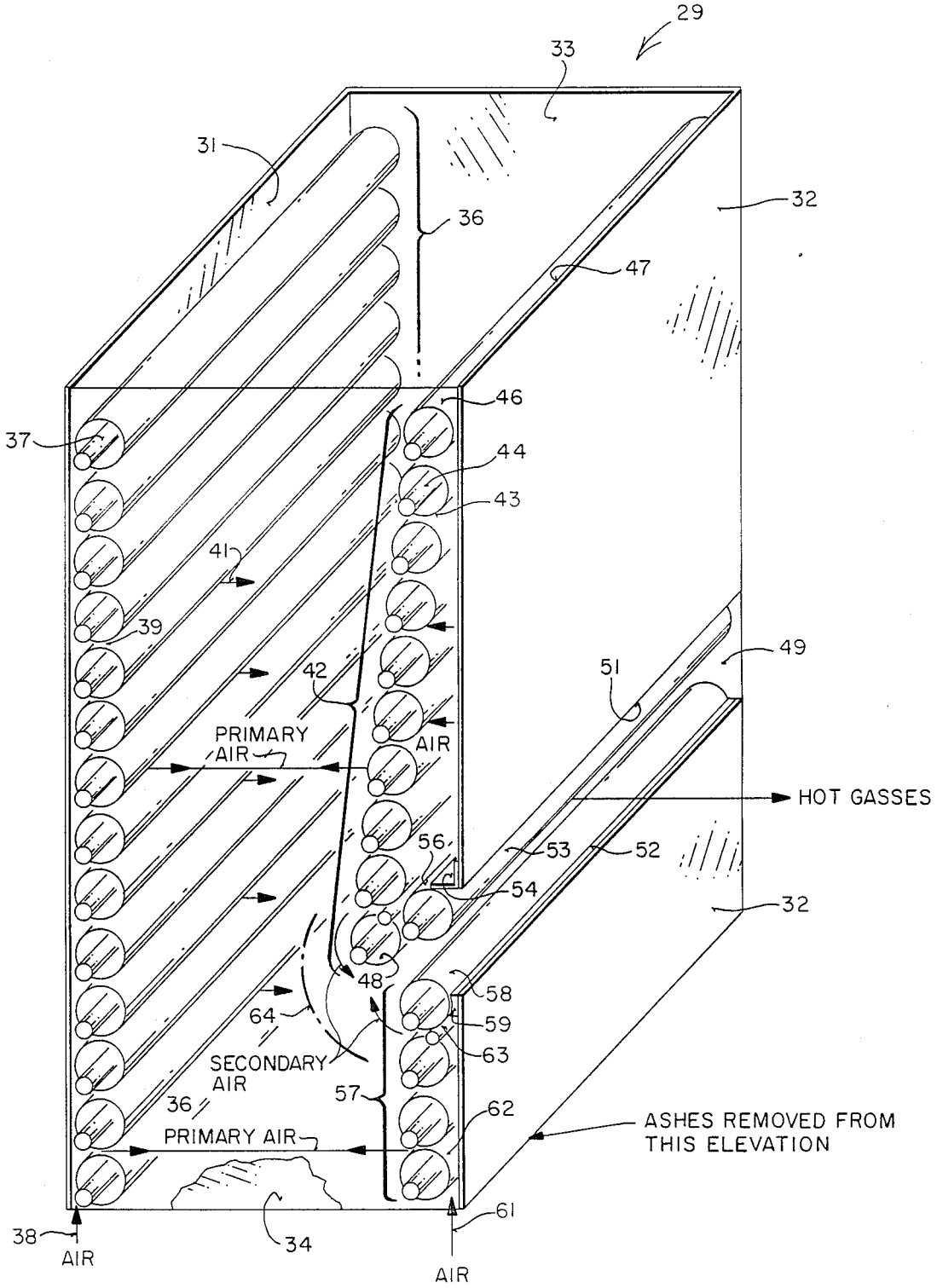
FIG. 3 is a schematic perspective view of the combustion chamber of the furnace illustrating a generally rectangular housing two of the inner walls of which are lined with water-cooled tubes in a manner to permit primary air to pass horizontally between the tubes in two separated sections of the housing, and secondary air to activate the incandescent filter being admitted between the tubes in the area where the gases must escape from the housing by passing through the incandescent filter.
Figure 4:
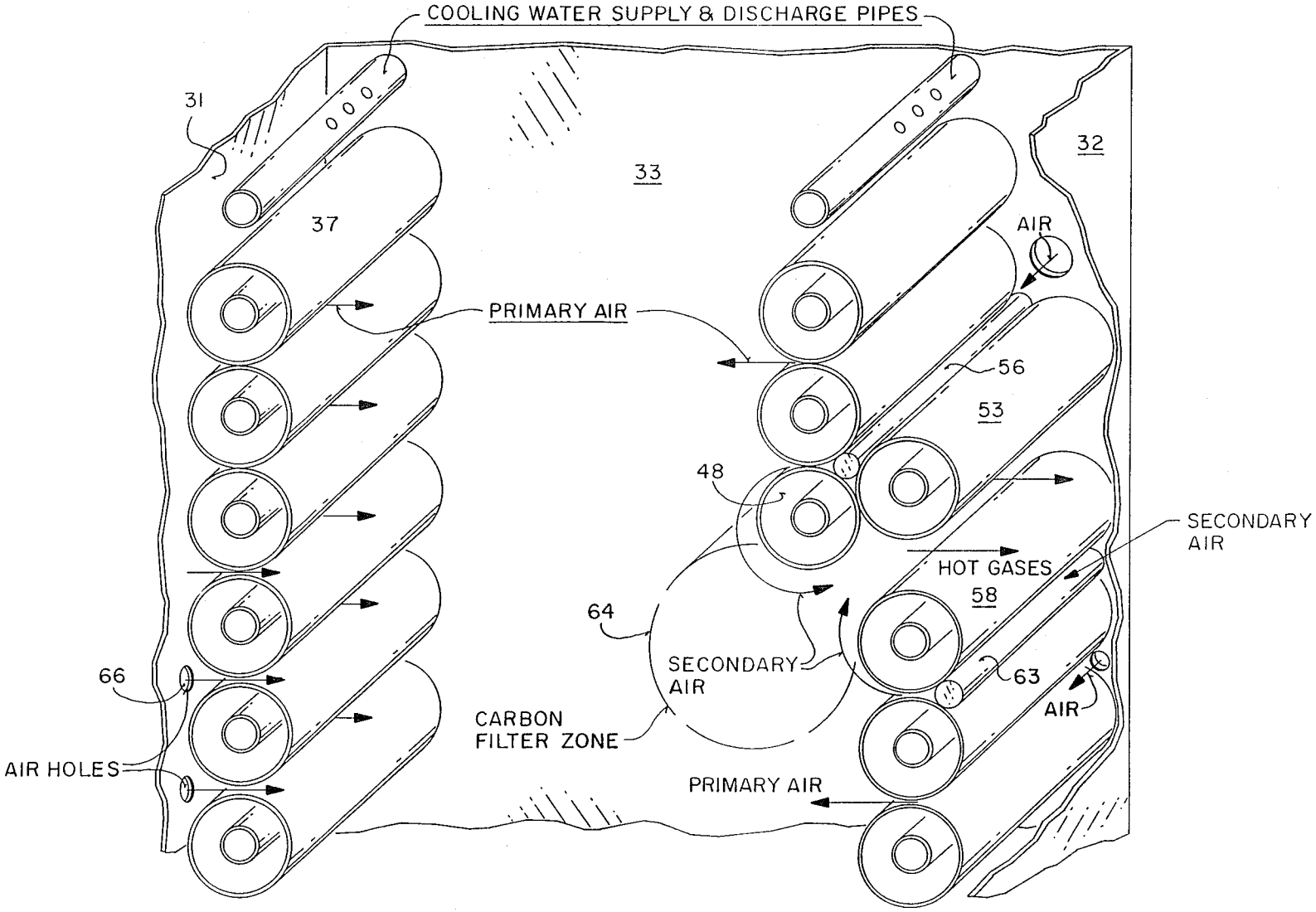
FIG. 4 is an enlarged fragmentary view in perspective showing more clearly the relationship of the tubes and the means for controlling the admission of both primary and secondary air into the combustion chamber, particularly in the carbon filter zone through which hot gases must pass before they are discharged from the combustion chamber.
Figure 8:
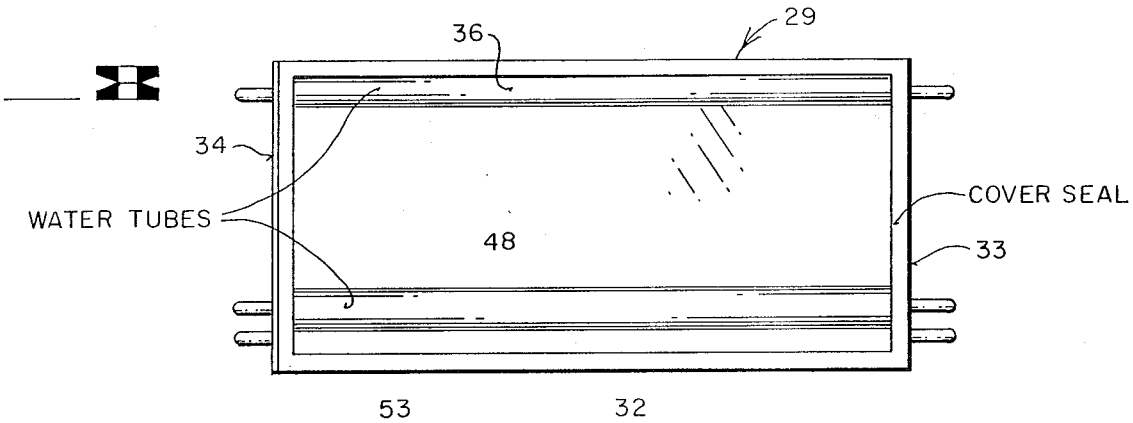
FIG. 8 is a plan view of the structure shown in FIG. 5. While the combustion chamber illustrated in FIGS. 5 through 8 normally is provided with a cover to seal the top end of the combustion chamber, the cover has been omitted in these figures in the interest of clarity.
Figure 7:
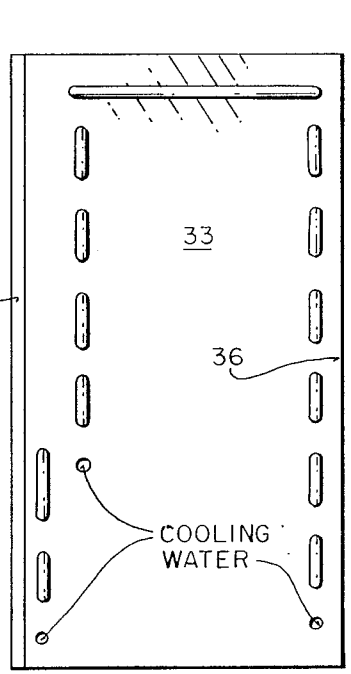
FIG. 7 is a right side elevational view of the structure illustrated in FIG. 5.
Figure 5:
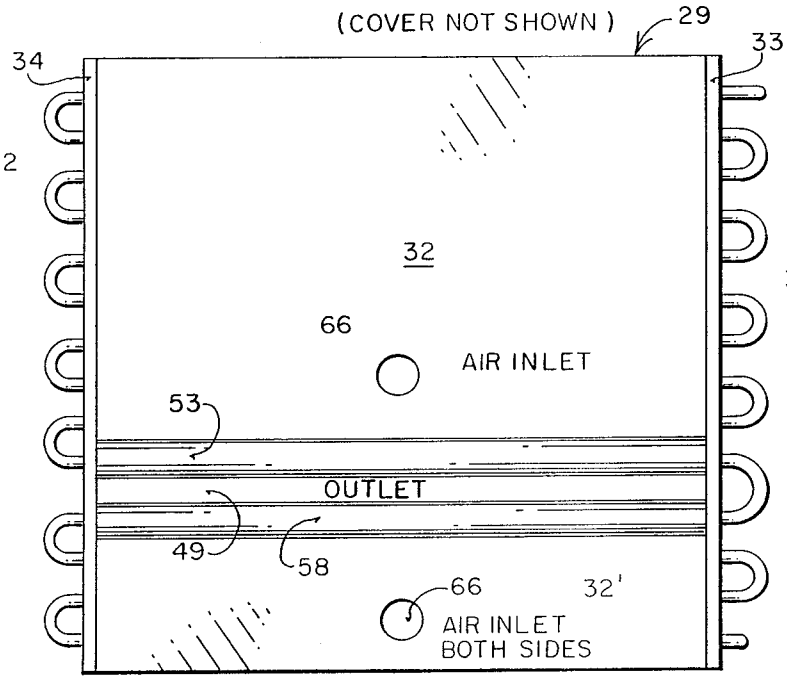
FIG. 5 is a side elevational view of the combustion chamber viewed from the side from which the hot gases exit the combustion chamber, and illustrating the manner of interconnection of the water-cooled tubes within the combustion chamber.
Figure 6:
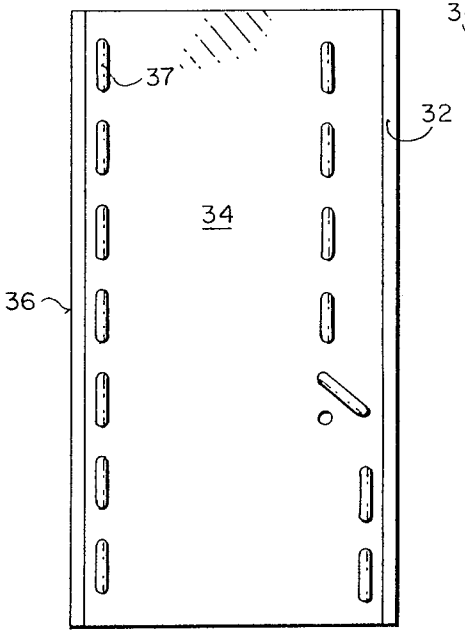
FIG. 6 is a left side elevational view of the structure illustrated in FIG. 5.

As indicated above, FIG. 3 illustrates schematically the interior construction of the combustion chamber that may be utilized in the furnaces designated generally by the numerals 2 and 14 in FIGS. 1 and 2, respectively. Referring to FIG. 3, it will be seen that the combustion chamber includes an enclosure designated generally by the numeral 29, the enclosure being preferably fabricated from appropriate sheet metal, welded into a rectangular configuration having a left wall 31, a right wall 32, and end walls 33 and 34. Only a portion of the end wall 34 is illustrated, the remainder being broken away to reveal the internal construction. Internally, the combustion chamber 29 is provided with a cluster of water tubes 36, the water tubes being welded to opposite end walls 33 and 34 of the combustion chamber, and water being admitted to the tubes through appropriate conduits 37. As illustrated, the water tubes 36 are arranged in a vertical series and are spaced apart vertically so as to provide for the passage of air between adjacent tubes. With respect to the cluster 36 of water tubes, the air is admitted from the bottom of the furnace at 38, passes upwardly between the wall 31 and the bank of water tubes, and then changes its direction and is injected into the combustion chamber of the furnace in a horizontal direction through the relatively narrow openings 39 between adjacent water tubes, the air entering the combustion chamber in the direction of the horizontal arrows 41. On the opposite wall 32 of the combustion chamber, there is another cluster 42 of vertically arranged water tubes also arranged in a near vertical series with spaces 43 between adjacent water tubes, these water tubes also being connected by appropriate conduit means 44 to the conduits 37 associated with the cluster of water tubes 36. The spaces 43 between the water tubes included within the cluster 42 provide for the passage of primary air horizontally into the combustion chamber in the same manner that primary air is admitted into the combustion chamber through the cluster 36 of water tubes. However, there is a difference in the cluster 42 of water tubes in that this cluster is inclined slightly to the wall 32 with which it is associated, the upper tube 46 for instance being contiguous to the inner surface 47 of the wall 32 to thus form an air seal between these two members, while successively lower water tubes are spaced farther and farther away from the inner surface 47 of the wall 32, with the maximum distance being represented by the water tube 48 at the bottom of the cluster. As illustrated, an exit slot 49 is provided in the wall 32, extending the full width of the panel 32, and having an upper edge 51 and a lower edge 52. Associated parallel to the upper edge 51 is a water tube 53 the upper periphery of which is welded to an angle bar 54 which is in turn welded to the lower edge 51 of the panel 32 that defines the slot 49. In this position, the water tube 53 is also contiguous to the water tube 48, as illustrated, thus defining the upper limit of the gate through which hot products of combustion must pass in order to exit from the combustion chamber. It should be noted that to admit air into the generally triangular space between the cluster 42 of water tubes and the side wall 32, there is provided appropriate apertures in the side wall, while secondary air is admitted between water tubes 48 and 53 by valve means 56.

Below the exit slot 49, and parallel to the wall portion 32' which constitutes a continuation of the wall panel 32 except for the slot 49, there is provided a third cluster 57 of water tubes, the uppermost water tube in this cluster being designated generally by the numeral 58 and having its periphery next adjacent the wall 32' welded to a reinforcing member 59 which spaces the associated peripheries of the water tubes away from the inner surface of the panel 32', to provide an air space between the wall panel 32' and the water tube cluster 57, air being admitted in the direction of the arrow 61, and being admitted into the combustion chamber through the spaces 62 provided between associated and parallel water tubes. While the air admitted in the direction of the arrow 61 constitutes an upwardly moving mass of primary air that then is injected horizontally into the combustion chamber, it is noted that valve means 63 are provided between the upper water tube 58 and the next adjacent lower water tube to control the amount of secondary air that is admitted into the combustion chamber in the carbon filter zone 64 formed immediately adjacent to and tending to block the opening through the slot 49 from the interior of the combustion chamber. Obviously, the carbon filter zone 64 is formed from incandescent coals of fuel that is always kept at a level from above the lowest tube in the cluster 57 to above the exit slot 49, thus always maintaining incandescent coals in front of the exit slot 49 where fresh secondary air keeps them in an incandescent state.

For purposes of clarity, the combustion chamber designated generally by the numeral 29 would normally be provided with a sealed cover. However, in the interest of expediency and for clarity, the structure is shown with the cover removed. In this respect, and referring to FIG. 4, where the housing of the combustion chamber is broken away, it will be noted that with respect to the cluster 36 of water tubes mounted in spaced relation to the wall 31, appropriate air holes 66 are provided in the outer wall 31 to admit air into the space between the water tubes and the interior surface of the wall. While only two such air holes have been illustrated, it is apparent that more may be added vertically and horizontally in order to admit the requisite amount of primary air to maintain combustion within the combustion chamber. Also, as indicated above, the carbon filter zone 64 is kept incandescent with secondary air the amount of which is controlled by the valve means 63 which may be rotated to open or close to a desirable degree the space 62 between the upper water tube 58 and the next adjacent lower water tube against which the control valve 63 impinges. It will thus be seen that fuel from above the outlet slot 49 continually replenishes the carbon consumed in the filter. Fuel from above the outlet burns in a downdraft, while fuel below the exit slot 49 burns in an updraft. Thus, none of the products of combustion from the fuel pile can reach the outlet slot without passing through the hot incandescent carbon filter zone 64. Obviously, ash that builds up within the combustion chamber may be removed from the underside of the furnace combustion chamber, preferably below the cluster 57 of water tubes.

Referring to FIGS. 5 through 8, it will there be seen that the general assembly of the combustion chamber is illustrated, again the cover being omitted for purposes of clarity. The manner of interconnection of the various clusters of water tubes is illustrated, and of particular importance is the fact that the outlet slot 49 from the housing is actually defined between the adjacent yet spaced peripheries of the water tubes 53 and 58. Within the combustion chamber, behind these two water tubes, lies the carbon filter zone through which products of combustion must pass in order to exit the system.

Figure 9:
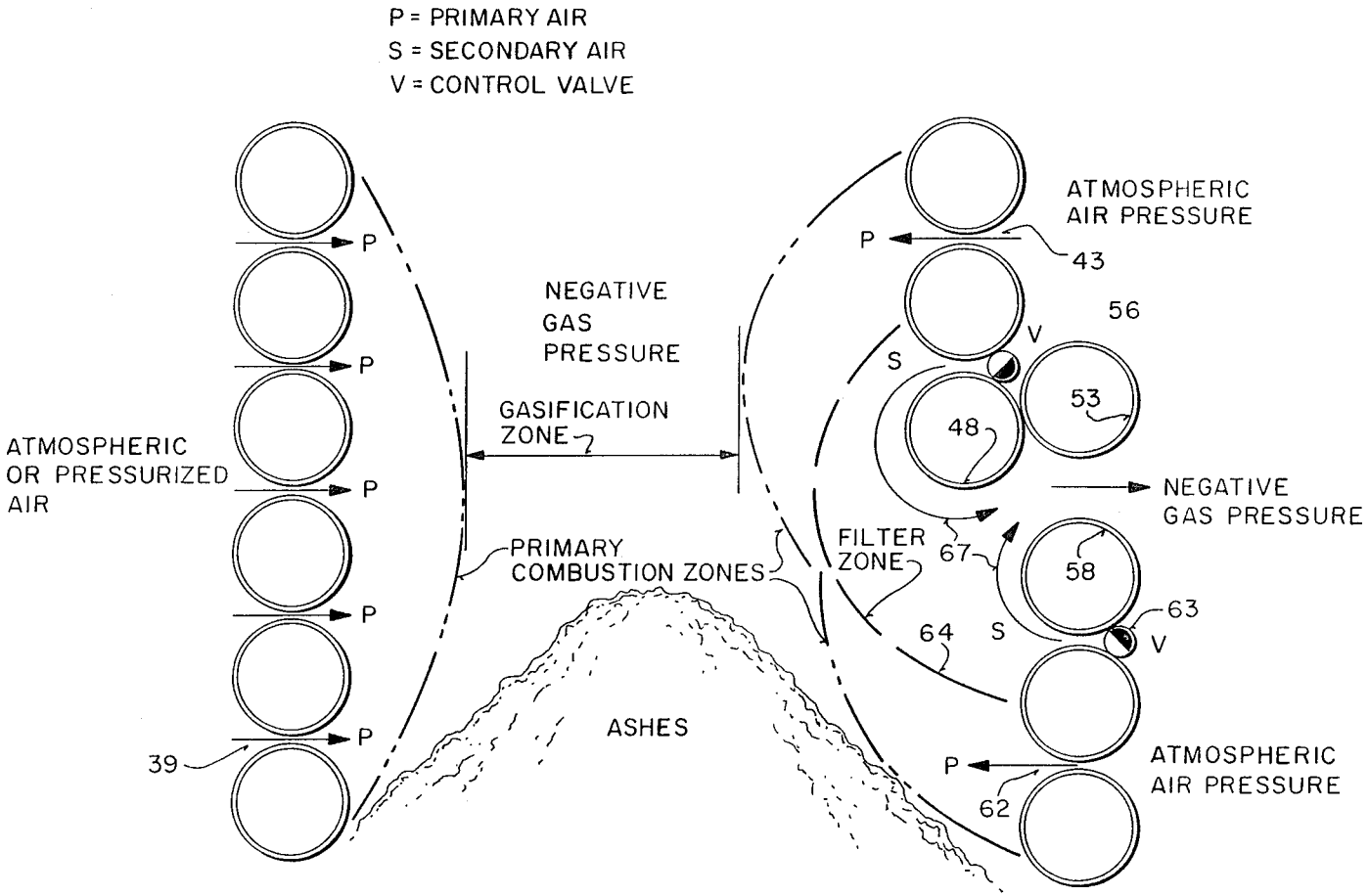
FIG. 9 is a schematic view illustrating the operation of the furnace in terms of the location of the ash heap in relation to the cooling tubes and the combustion zone within the combustion chamber.

Referring to FIG. 9, it will there be seen schematically that either atmospheric or pressurized air may be admitted through the spaces 39 between the water tubes forming the cluster 36 of such tubes. In the same manner, air under atmospheric pressure or otherwise is admitted through the slots 43 that exist between the water tubes forming the cluster 42 as illustrated in FIG. 3. As previously indicated, the carbon filter zone 64 spans the opening from the combustion chamber, maintaining an incandescent layer of fuel in front of the opening. Where necessary, secondary air under pressure is admitted to the filter zone as indicated by the arrows 67 through the slots that exist between the water tubes 48 and 58 and their associated and adjacent water tubes, the amount of secondary air being controlled by the valve means 56 and 63. Where necessary, negative gas pressure is applied to the outlet opening to force the products of combustion that are released within the combustion chamber to pass through the incandescent filter zone and out of the combustion chamber. As indicated in FIG. 9, the ashes within the combustion chamber build up to a height substantially equal to the water tube 58 that marks the bottom limit of the exit for gases from the combustion chamber, and the primary combustion zone lies immediately above the ash heap, which falls away at an angle to the base of the furnace. As combustion continues, and the ash heap grows, equipment in the form of a screw conveyor buried adjacent the bottom of the furnace and embedded in the ashes may be activated to maintain the height of the ash heap, thus maintaining the proper relationship between the bed of combustible fuel, the ash heap, and the incandescent carbon filter zone spanning the exit from the combustion chamber defined by the water tubes 48, 53 and 58.

Figure 10:
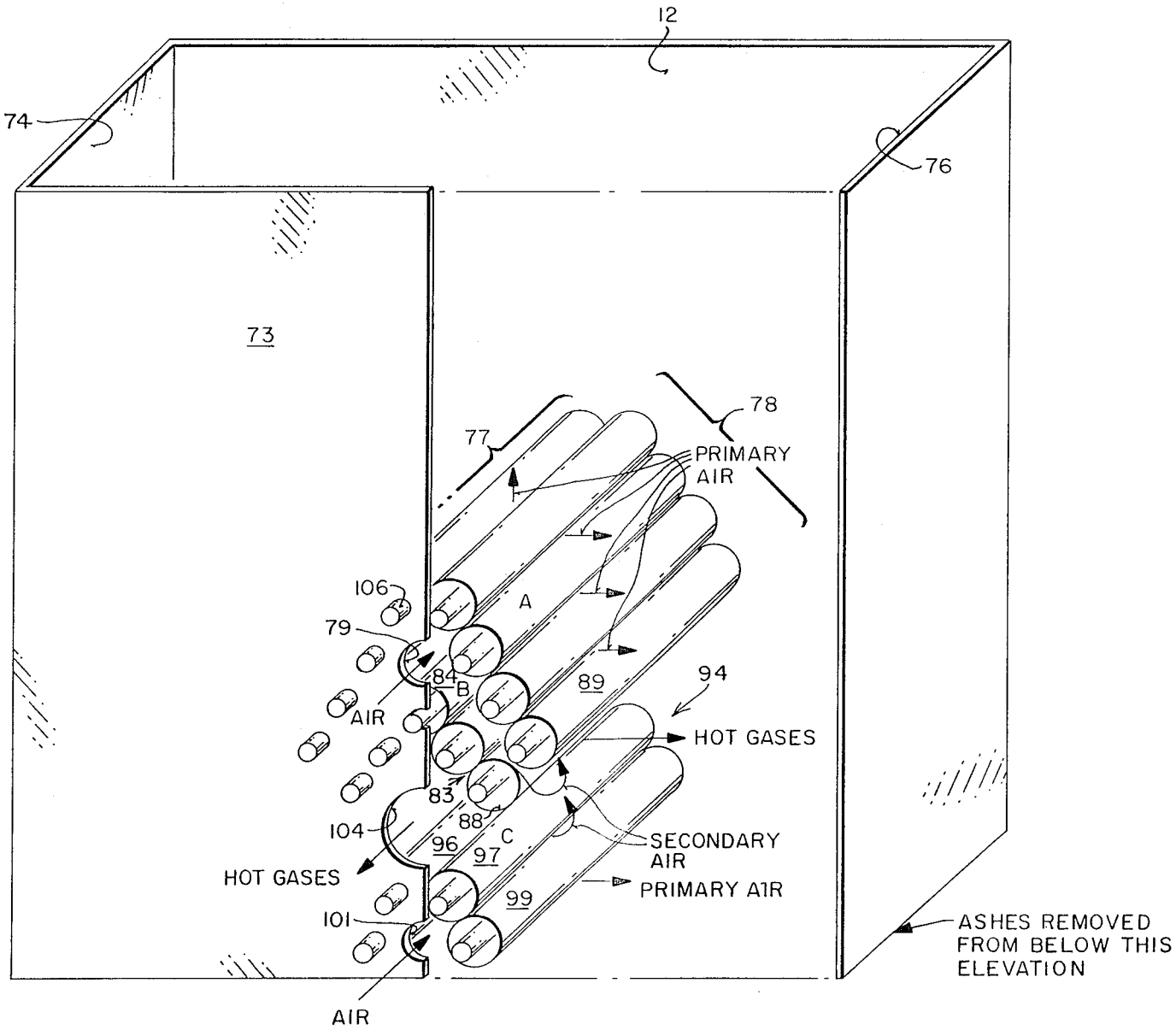
FIG. 10 is a perspective view illustrating schematically a second embodiment of my invention including an arrangement of the water-cooled tubes within the combustion chamber in patterned clusters which keeps the combustion zone away from the exterior walls of the furnace.

In the embodiment of the invention illustrated in FIG. 10, the combustion chamber is designed in a manner to keep the combustion zones away from the exterior walls of the furnace. Thus, the normally sealed enclosure designated generally by the numeral 71 and constituting the combustion chamber of the furnace is here shown with the cover removed and with a rear wall 72, a front wall 73 and end walls 74 and 76. It should be noted for purposes of clarity, and to reveal the internal construction, one-half of the front panel 73 is omitted. Thus, within the combustion chamber and welded between the front and rear walls 73 and 72, respectively, are clusters 77 and 78 of water tubes, here each cluster being comprised of four water tubes arranged in parallel relationship within each cluster, with the clusters 77 and 78 being arranged to form a triangle as illustrated. Note that the individual water tubes forming these two clusters 77 and 78 are spaced from each other so that primary air admitted through the air inlet port 79 may exit between the individual water tubes through slots 81 provided therebetween, to provide primary air for the fuel bed within which the water tubes lie embedded. As indicated, the top of the fuel bed always lies above the plane 82 which is substantially in the same plane as the axis of the uppermost water tubes in each of the clusters 77 and 78.

Figure 11:
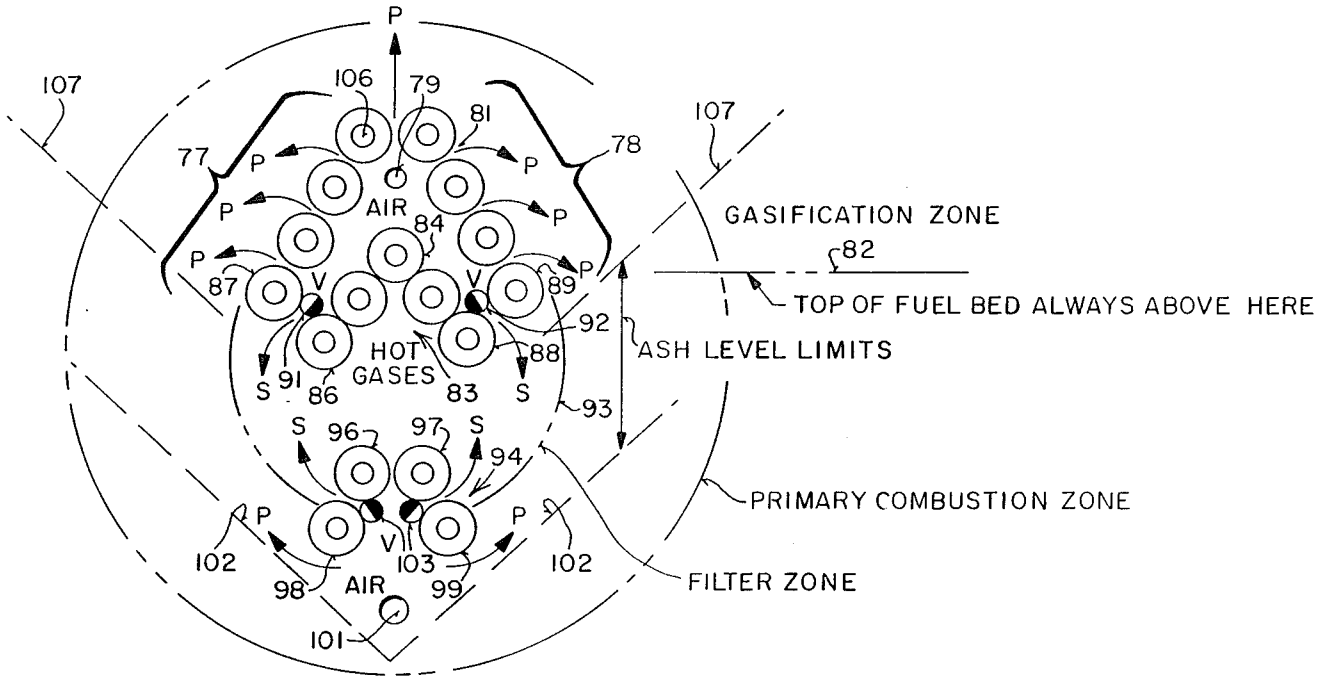
FIG. 11 is a schematic view of the cluster arrangement of the tubes illustrated in FIG. 10 illustrating the location of the combustion chamber in relation to the ash level and the fuel bed within the combustion chamber.

A third cluster 83 of water tubes arranged in a triangular pattern as illustrated is arranged with respect to the two clusters 77 and 78 so that the uppermost or apex-forming water tube 84 lies within the triangular limit formed by the triangular arranged cluster 77 and 78, while the peripheries of the water tubes forming the triangular cluster 83 lie contiguous to one another so that air cannot pass from the air chamber formed between these clusters between the water tubes of the triangular cluster 83. Note however that the lower water tube 86 is spaced from the lower water tube 87 of the cluster 77, and that the lower tube 88 of the cluster 83 is spaced from the lower water tube 89 of the cluster 78. Such spacing between the water tubes 86–87 and 88–89 enables the placement of air valves 91 and 92 to control the passage of secondary air through the spaces between the water tubes 86–87 and 88–89 so that sufficient air is admitted to the hot gases formed within the combustion chamber, and the fuel contained surrounding the clusters 77, 78 and 83 to form an incandescent filter zone 93 that encompasses the lower water tubes 87 and 89 of the tube cluster 77 and 78 and a fourth and lowermost tube cluster designated generally by the numeral 94. This cluster, as illustrated in FIG. 11 lies spaced from and below the cluster 83 of water tubes, and is composed of four water tubes arranged in a generally quadrilateral pattern which includes two upper water tubes 96 and 97 and two lower water tubes 98 and 99. Air under pressure or atmospheric air is admitted through an inlet port 101 which discharges air into the space below the cluster 94. Such air is controlled in one respect with respect to primary combustion by the surface 102 of the ash pile that builds up below the lower cluster 94 of water tubes, air passing between the outer periphery of the water tubes 98 and 99 and the adjacent surfaces 102 of the ash heap. Additionally, longitudinally extending air valves 103 are provided contiguous to the spaced water tubes 96–98 and 97–99 to control the passage of secondary air in the direction of the arrows indicated, thus maintaining the fuel bed in the area between the tube cluster 83 and the tube cluster 94 at incandescent heat, so that gases or unburned articulate matter resulting from combustion are forced to pass through the incandescent fuel to reach the outlet port 104 formed in the front wall 73. As in the previous embodiment illustrated in FIGS. 1 through 9, the water tubes in this embodiment are interconnected by appropriate conduit means 106 that operate to circulate cooling water through the various water tubes.

With respect to this embodiment, it is noted that while the ash level may be maintained at the level indicated by the surfaces 102, the ash level may also be increased to the level indicated by the surface 107.

Figure 12:
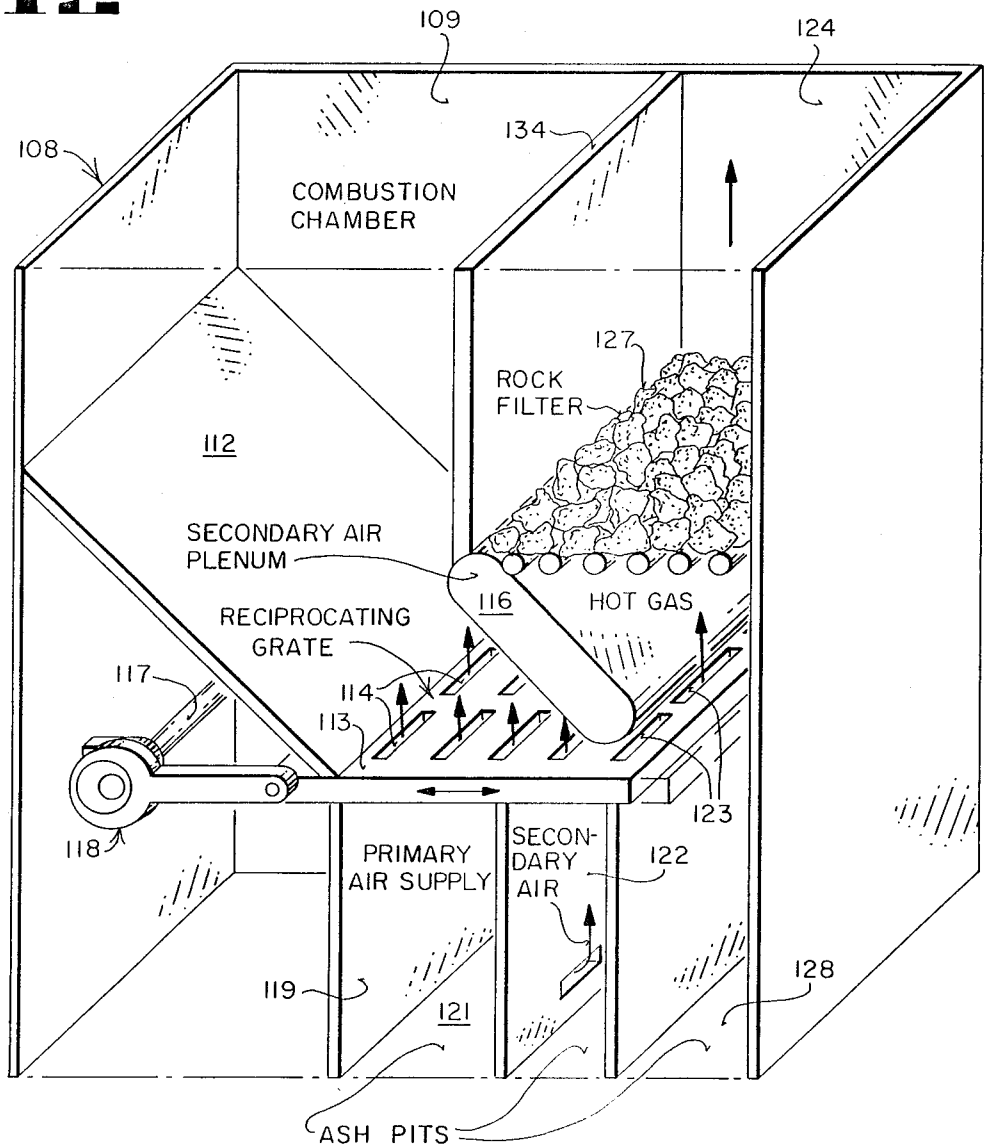
FIG. 12 illustrates a third embodiment of my invention in which a reciprocating grate advances the fuel within the combustion chamber and with the hot gases of combustion exiting from the combustion chamber through an incandescent filter activated by secondary air applied to the incandescent filter at the point of egress of the hot gases.
Figure 13:
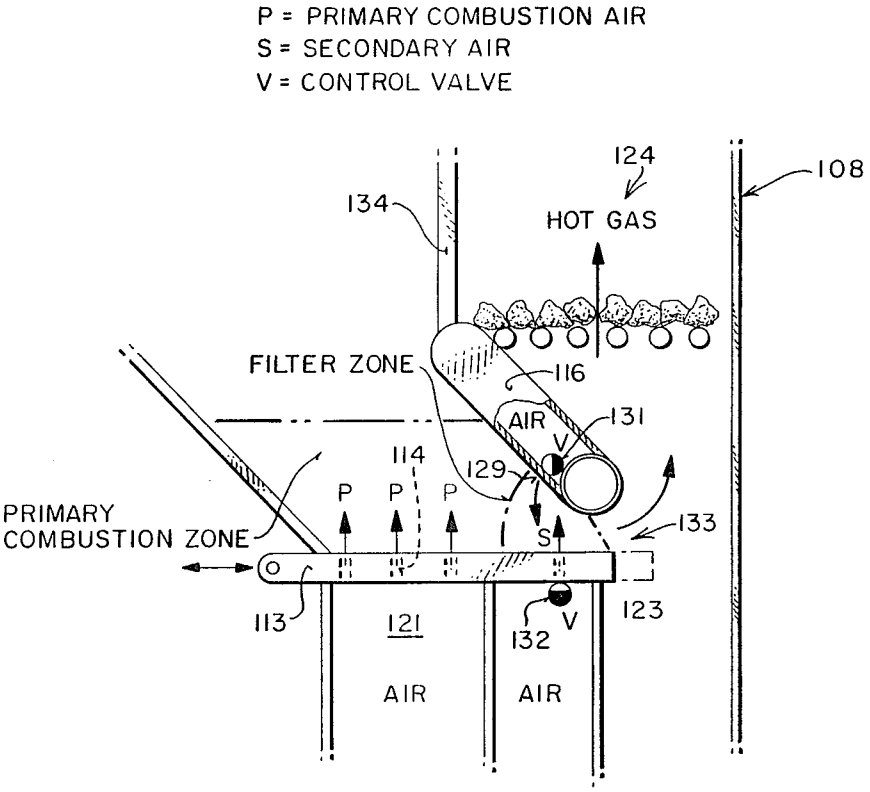
FIG. 13 is a schematic view illustrating the method of operation of the furnace illustrated in FIG. 12.

Referring to the embodiment of the invention illustrated in FIGS. 12 and 13, there is there illustrated a furnace designated generally by the numeral 108 provided with a combustion chamber 109 having a sloping bottom 12 which causes fuel of whatever kind deposited in the combustion chamber by conventional means to slide downwardly onto a reciprocating grate 113. The grate is formed preferably from fire resistant cast iron, is provided with slots 114 adapted to admit air into the combustion chamber in close and intimate contact with the fuel that lies above the grate in the gore formed by the grate and a secondary air plenum chamber designated generally by the numeral 116. The grate 113 is caused to reciprocate by a shaft 117 operated by an appropriate motor (not shown), the shaft 117 rotating an off-center cam assembly designated generally by the numeral 118 as illustrated which when rotated causes the reciprocating grate to reciprocate horizontally as illustrated by the arrow. Primary air is provided through a passageway 119 closed by a bottom wall 121 which also functions as an ash pit, the primary air passing upwardly through the slots 114 to provide adequate combustion air for the fuel bed caught between the underside of the secondary air plenum 116 and the top surface of the grate. As the fuel bed burns, and advanced into the apex of the triangle formed by the surface of the grate and the secondary air plenum, secondary air is channeled from the passageway 122 upwardly through the series of slots 123 in the grate which because of reciprocation always find themselves at the apex of the triangular cross-section portion of the combustion chamber, the secondary air from the secondary air plenum and from the secondary air chamber 122 causing the fuel in the gore to be elevated to an incandescent temperature through which all fuel and combustible fumes and entrained unburned solids must pass before they leave the furnace through the exit chamber 124. Provided in the exit chamber 124 above the secondary plenum 116 is a grate formed by multiple rods 126 forming a mesh or supporting surface for a rock filter 127 as shown. Thus, hot gases that pass through the incandescent filter formed by the fuel subjected to secondary air as it leaves the grate rise under the rock filter and pass through the filter, the filter stopping all fly ash that may be entrained within the stream of hot gases. As the fuel in the combustion chamber moves across the top of the grate to the edge, any unburned material that is too heavy to be entrained within the stream of hot gases, drops through the slots 123 or off the end of the grate, and into the ash pit 128. Ash may be removed from the ash pits in any convenient manner such as by automatic screw conveyors. In the interest of clarity in the illustration, the top panel of the furnace 108 and the front panel have been removed to expose the interior arrangement of parts. It should of course be understood that the furnace is a completely closed and sealed unit except for appropriate openings for admitting fuel into the combustion chamber and for permitting the exit of hot gases through the exit channel 124.

The method of operation of the furnace 108 illustrated in FIG. 12 is illustrated schematically in FIG. 13 where it is seen that the fuel fed into the furnace forms a primary combustion zone to a depth beyond the midpoint of the secondary air plenum 116. Primary combustion air from the ash pit 121 is cause to flow upwardly through the slots 114 to provide adequate combustion air for the fuel bed for the entire depth of the primary combustion zone. Within the plenum 116, there are formed secondary air outlets 129 controlled by a valve 131 which meters the amount of secondary air that is permitted to pass through the slots 129 and to intermix with the concentrated load of fuel held in the gore between the plenum chamber and the top surface of the grate. Additionally, a valve 132 associated with the slots 123 in the grate, controls the upwardly directed secondary air that is injected into the burning fuel bed at the gore, thus enhancing the temperature of the fuel bed at this location, raising it to incandescence, and forcing the products of combustion that are released from the primary combustion zone to be fed back through the incandescent filter zone and to exit through the gap 133 and from there rise upwardly through the rock filter 127 and to exit through the passage 124. Because the products of combustion are forced to pass through the incandescent filter formed by the fuel trapped in the gore at elevated temperatures, all combustibles entrained in the products of combustion are burned before they pass through the rock filter. As illustrated in FIGS. 12 and 13, the combustion chamber 109 is separated from the exit passageway 124 by a transverse wall 134.

The embodiments of the invention described and illustrated heretofore are of the type that utilize fuel of the type that comes in large chunks, such as coal or wood. However, there are many instances in which fuel is of a type that does not generate large coals which may become compacted into a mass through which the products of combustion may be drawn. Such fuels are categorized as low ash or no ash fuels and must be handled in a special way in order to create an incandescent filter from the low ash or no ash fuel. Accordingly, referring to FIGS. 14 and 15, the furnace there illustrated is designated generally by the numeral 136 and includes a housing 137 including a fuel chamber 138 defined by four walls and a cover, the cover being removed in this illustration along with the front panel for purposes of clarity in this illustration. Formed in the bottom of the housing is an air passage 139, which is defined at its upper level by a grate 141 having slots 142 therein to permit the passage of air from the air chamber 139 through the grate 141 and into the bed of crushed fire brick 143 deposited in a predetermined thickness upon the top surface of the grate. Fuel fed into the housing 137 falls upon the top surface of the crushed brick bed and having been ignited, burns with either low ash or no ash, primary air being supplied to the burning fuel through the crushed fire brick bed on which it rests. Smoke and fumes from this burning fuel in the fuel chamber 138 is forced to pass through exits 144 into a filter chamber designated generally by the numeral 146 attached to the wall of the housing 137. Secondary combustion air is provided through a passageway 147, the air passing downwardly through appropriate slots 148 in the bottom of the passageway 147, and exiting through the wall 149 through slots 151. This secondary air causes a down draft that helps to increase the temperature of the products of combustion from the primary combustion zone immediately above the crushed fire brick, and in this function is assisted by a rising current of secondary air that passes through an appropriate slot 152 formed between the grate and the wall 149. Under the impetus of the pressure generated within the primary combustion chamber, the pressure of primary combustion air admitted into the combustion chamber and the secondary air, smoke and fumes from the primary combustion chamber pass through the ports 144 into the secondary combustion chamber 146 where such smoke and fumes are forced into and through a bed of crushed fire brick 153 deposited above openings 154 that communicate with the inlet ports 144. Carbon particles entrained in the stream of smoke and fumes fill the interstices between the crushed fire brick, and ignite with the help of the secondary air supply, thus creating from such carbon particles an incandescent filter through which any unburned particles entrained within the stream of smoke and fumes must pass to thus be burned prior to exiting from the system through an appropriate outlet.

Figure 14:
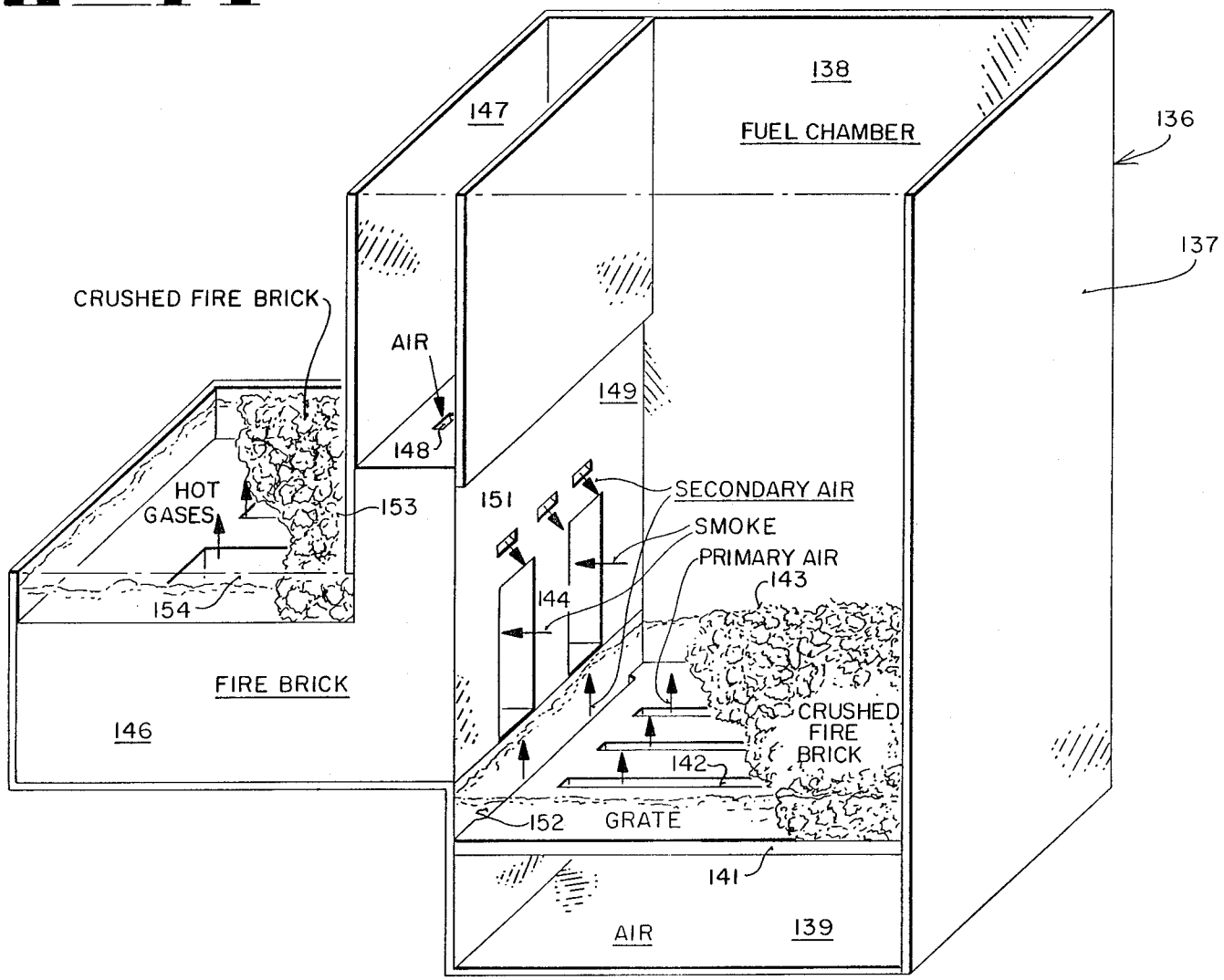
FIG. 14 is a fourth embodiment of the invention that utilizes microscopic particles of carbon in the smoke from the primary combustion to coat a filter material, the carbon coating being kept at an incandescent temperature by the admission of appropriate amounts of primary and secondary air into the combustion chamber as illustrated.
Figure 15:
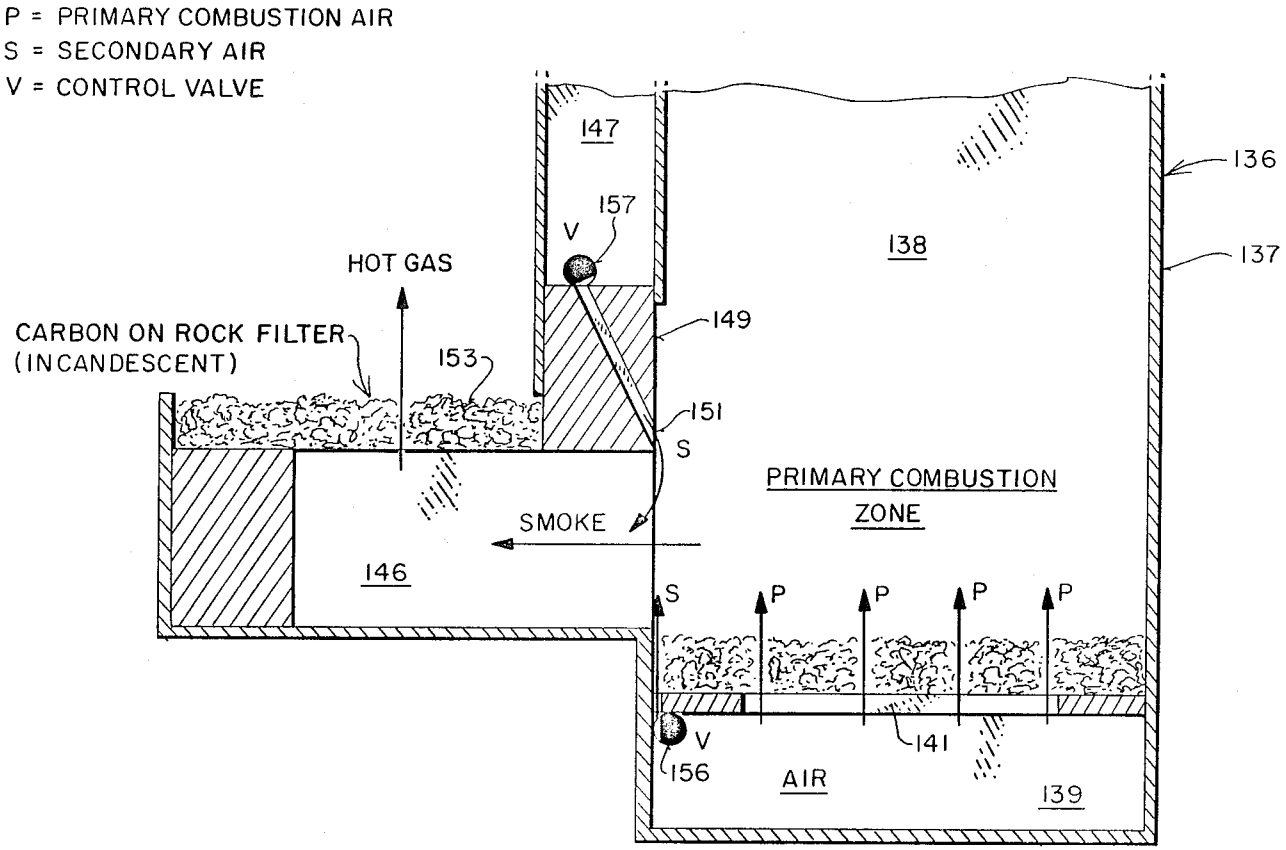
FIG. 15 is a schematic view illustrating the method of operation of the furnace illustrated in FIG. 14.

Referring to FIG. 15, it will there be seen that the method of operation of the furnace 136 illustrated in FIG. 14 is illustrated schematically, primary air passing upwardly through the slots 142 in the grate 141, and the slot 152 being controlled by an appropriate valve 156 which by being rotated from outside the furnace controls the amount of secondary air admitted upwardly to be sucked into the openings 144 leading into the secondary chamber 146. Additionally, the slots 148 are controlled by a valve 157 manipulation of which again controls the amount of secondary air emanating from the slots 151 which is also sucked into the passageways 144 to carry smoke and fumes into the secondary chamber 146, where entrained carbon particles are imposed upon the crushed fire brick bed 153 to fill the interstices thereof and to form an incandescent filter through which all combustibles in the stream of hot gases must pass before they exit the system.

Figure 16:
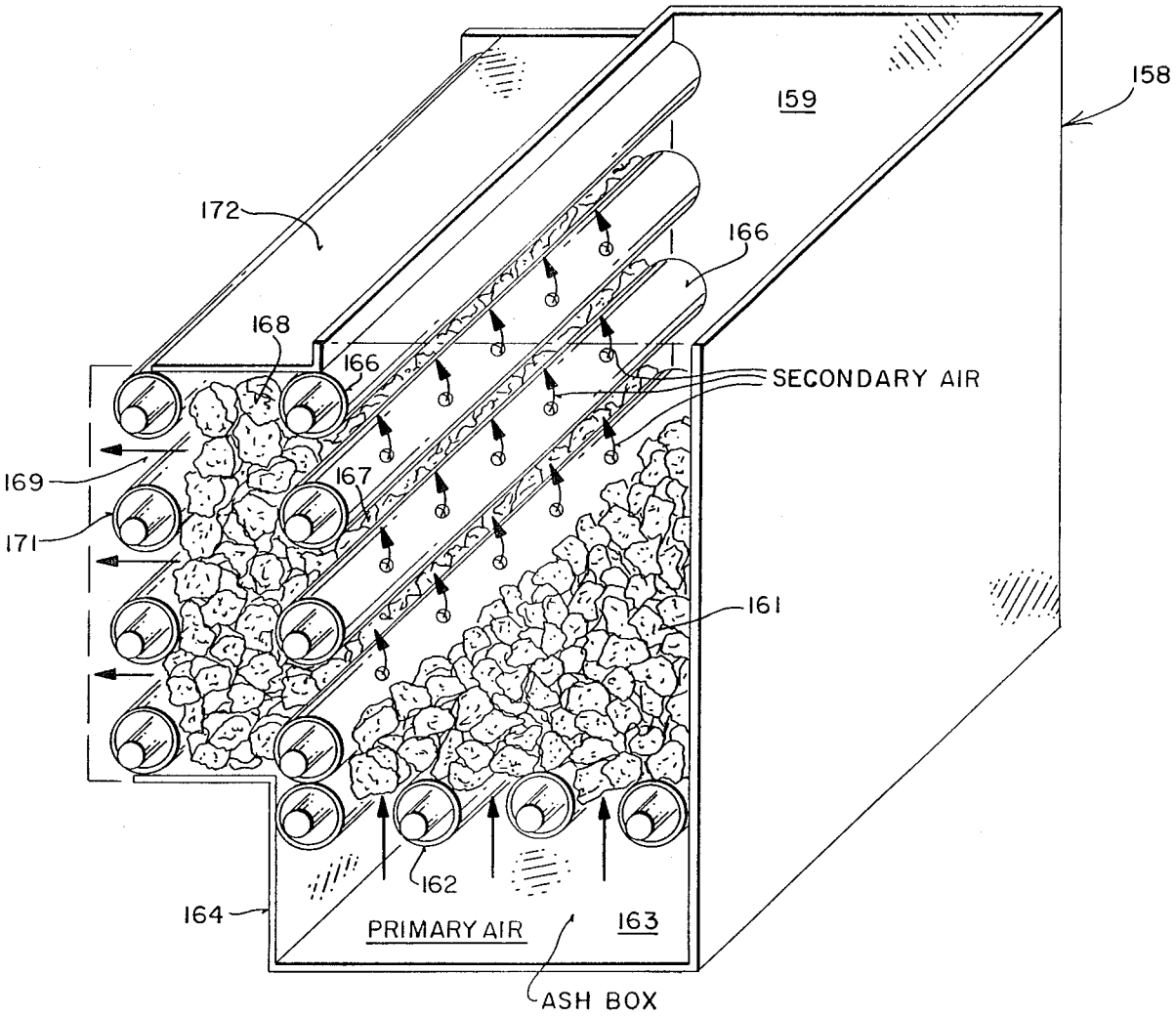
FIG. 16 is a schematic view of another embodiment of a combustion chamber equipped with a carbon coated filter adapted to be maintained at incandescence and through which the hot gases from the primary combustion area must pass to exit the combustion chamber.

In the embodiment of the invention illustrated in FIG. 16, there is illustrated another carbon coated incandescent filter system in which the housing is again a sealed unit designated generally by the numeral 158 and includes an interior combustion chamber 159 into which low-ash or no-ash fuels are fed so as to rest upon a bed of crushed fire brick 161 which is in turn supported by water-cooled grate tubes 162 which define the top surface of a primary air plenum and ash box 163. One wall 164 of the housing is interrupted and the opening so formed is partially closed by a vertical series of horizontally extending water-cooled tubes 166, spaced vertically from each other to provide horizontal slots therebetween so that products of combustion from the primary combustion chamber 159 may be forced through such slots 167 by the pressure of the primary air injected into the combustion chamber and the pressure created by the heat generated by the burning fuel, which is of course sealed within the housing of the furnace. While this illustration for purposes of clarity omits the cover of the furnace and the front panel, it should be understood that the cover and front panel are omitted merely for clarity. Additionally, secondary air may be admitted in the region of the opening formed by the interruption of the wall 164, the air preferably being admitted into the primary combustion chamber in close association with the slots 167 between the water cooled tubes 166 so that such secondary air, accompanied by hot smoke and fumes from the primary combustion zone immediately above the bed of crushed fire brick 161 is forced through the slots 167 and into the bed 168 of crushed fire brick on the opposite side of the tubes 166 from the primary combustion zone. As before, smoke and soot collect on the fire brick 168, are ignited by the intense heat, which is elevated to incandescence by the secondary air passing through the slots 167, and therefore function to burn all combustible materials that are entrained in the stream of hot gases emanating from the primary combustion zone. These hot gases now cleaned of all entrained solids and toxic fumes, are permitted to exit through appropriate slots 169 formed in a bank of vertically arranged water cooled tubes 171 as illustrated. Obviously, the bed of crushed fire brick 168 is contained within a housing 172 attached to the furnace housing 158 so that the entire assembly is otherwise sealed with the exception of the outlet slots 169 for hot but clean gases which may be channeled appropriately to a utilization device such as a converter which extracts the heat from such gases and generates steam to operate a turbine for the generation of electricity.

Having thus described the invention, what is believed to be new and novel and sought to be protected by letters patent of the United States is as follows:

I claim:

1. In a furnace adapted to be fired by combustible fuel fed into the furnace from a source of such fuel outside said furnace and equipped with an outlet from said furnace for products of combustion, the combination comprising:

(a) a combustion chamber within said furnace adapted to receive for combustion therein a mass of said combustible fuel and having a combustible fuel inlet and an outlet therefrom for the products of combusion:

(b) a primary combustion zone, defined in said combustible fuel and extending from above to below said outlet from which emanate unburned but combustible products of combustion in the form of smoke and gases when said combustible fuel is ignited, said primary combustion zone extending from above said outlet to below said outlet and spaced inwardly from said outlet for the products of combustion;

(c) a secondary combustion zone defined in said mass of combustible fuel interposed between said primary combustion zone and said outlet from said combustion chamber and through which secondary combustion zone all products of combustion emanating from said primary combustion zone must pass before passing out of the outlet from said combustion chamber, said secondary combustion zone spanning said outlet from the combustion chamber;

(d) means supplying primary combustion air into said combustion chamber and said primary combustion zone to support primary combustion therein of said combustible fuel; and (e) means cooperatively related with said secondary combustion zone selectively manipulable for supplying secondary combustion air into said secondary combustion zone and selectively adjustable to increase the temperature within said secondary combustion zone and maintain said secondary combustion zone at incandescence whereby unburned but combustible products of combustion in the form of smoke and gases emanating from said primary combustion zone are causeed to pass into said incandescent secondary combustion zone whereby to be consumed therein.

2. The combination according to claim 1, in which said primary combustion zone and said secondary combustion zone are defined within said combustion chamber by a multiplicity of transversely extending water tubes arranged in a plurality of clusters whereby said primary combustion zone is defined around said clusters of water tubes, while said secondary combustion zone is defined within the limits of said clusters of water tubes, and means are provided for admitting primary combustion air into said primary combustion zone and secondary combustion air into said secondary combustion zone.

3. The combination according to claim 2, in which two of said clusters of water tubes are arranged in generally triangular configuration having a relatively wide base comprised of laterally spaced water tubes, a third cluster of water tubes arranged in a generally triangular configuration with the apex thereof extending into the space between said first mentioned clusters of water tubes and the base thereof being formed by spaced water tubes adjacent the base water tubes of the first mentioned cluster of water tubes, a fourth cluster of water tubes within the combustion chamber disposed below said first, second and third clusters of water tubes to define a secondary combustion zone therebetween, said fourth cluster of water tubes being arranged in a generally quadrilateral configuration, and means associated with said third and fourth clusters of water tubes manipulable to control the quantity of air injected into said secondary combustion zone whereby the fuel therein is raised to an incandescent temperature and products of combustion from said primary combustion zone must pass through said incandescent secondary combustion zone before they emanate from said combustion chamber.

4. The combination according to claim 1, in which a reciprocating grate is mounted within said combustion chamber and having slots therein through which primary combustion air may be injected into said combustion chamber through said grate, a secondary air plenum mounted within said furnace and spaced above said grate at an angle thereto whereby to define said secondary combustion zone to include the space between said secondary air plenum and said reciprocating grate, a second grate mounted above said secondary air plenum and adapted to support a layer of filtering material thereon through which hot gases emanating from said furnace must pass before they exit from said furnace, and means associated with said secondary air plenum for selectively controlling the quantity of secondary combustion air injected into said secondary combustion zone whereby to increase the temperature of the fuel therewithin to incandescence whereby products of combustion emanating from said primary combustion zone must pass through said incandescent secondary combustion zone before passing through said filter.

5. The combination according to claim 4, in which means are operatively associated with said reciprocating grate and said secondary combustion zone to control the quantity of secondary combustion air injected into said secondary combustion zone.

6. The combination according to claim 4, in which means are provided for receiving unburned material that passes through said incandescent secondary combustion zone and is too heavy to be entrained within the stream of gases passing through said filter.

7. The combination according to claim 1, in which said primary combustion zone is defined on one side within said furnace by a grate having a plurality of apertures through which primary combustion air may pass upwardly into said mass of combustible fuel, means for injecting air through said grate into said combustion chamber, a layer of crushed fire brick superimposed and supported on said apertured grate and disposed to support thereon said mass of combustible fuel, means channeling products of combustion from said primary combustion zone to said secondary combustion zone, said secondary combustion zone including a mass of crushed fire brick through which said products of combustion from said primary combustion zone must pass to escape from said furnace, said mass of crushed fire brick adapted to intercept and retain from said stream of products of combustion carbonaceous unburned particles to form a carbon layer on said crushed fire brick in said secondary combustion zone, and means including a source of secondary combustion air injected into said combustion chamber and into said means for conveying said products of combustion to said secondary combustion zone whereby said carbonaceous material adherent to said crushed fire brick mass in said secondary combustion zone is elevated to incandescent temperatures to thereby secondarily consume combustible material entrained with said stream of gases from said primary combustion zone.

8. The combination according to claim 7, in which valve means are provided for controlling the quantity of secondary combustion air injected into the primary and secondary combustion zones.

9. The combination according to claim 8, in which means are provided for injecting secondary air into said combustion chamber in a downdraft direction, and separate means are provided for injecting secondary air into said combustion chamber in an updraft direction whereby the downdraft secondary air comingles with the updraft secondary air and both are injected into said secondary combustion zone.

10. The combination according to claim 1, in which said combustion chamber is provided with a horizontal grate formed by a plurality of laterally spaced water tubes extending between the ends of said combustion chamber, a layer of fire brick pieces on said horizontal grate, an air passage below said horizontal grate for admitting primary combustion air into said combustion chamber through the spaces between said spaced water tubes, a vertically arranged grate formed from a series of spaced water tubes defining one wall of the combustion chamber whereby products of combustion from said primary combustion zone may pass horizontally through said vertical grate, a plurality of vertically arranged and spaced water tubes spaced parallel from said vertical grate, a mass of fire brick pieces disposed in the space between said vertical grate and said vertical series of water tubes, whereby products of combustion emanating from said combustion chamber and passing through said vertical grate deposit unburned carbonaceous particles on said fire brick pieces disposed on the opposite side of said vertical grate from said combustion chamber, and means for injecting secondary combustion air into said secondary combustion zone whereby the carbonaceous particles adherent to said fire brick pieces are elevated to incandescent temperature whereby to consume combustible particulates entrained with said products of combustion emanating from said primary combustion zone.

11. In a furnace adapted to be fired by combustible fuel fed into the furnace from a source of such fuel outside said furnace and equipped with an outlet from said furnace for products of combustion, the combination comprising:

(a) a combustion chamber within said furnace adapted to receive for combustion therein a mass of said combustible fuel and having a combustible fuel inlet and an outlet therefrom for the products of combustion;

(b) a primary combustion zone defined in said combustible fuel from which emanate unburned but combustible products of combustion in the form of smoke and gases when said combustible fuel is ignited;

(c) a secondary combustion zone defined in said mass of combustible fuel adjacent said outlet from said combustion chamber and through which secondary combustion zone all products of combustion emanating from said primary combustion zone must pass before passing out of the combustion chamber;

(d) means supplying primary combustion air into said combustion chamber and said primary combustion zone to support primary combustion therein of said combustible fuel;

(e) means cooperatively related with said secondary combustion zone adapted to increase the temperature within said secondary combustion zone to incandescence whereby unburned but combustible products of combustion in the form of smoke and gases emanating from said primary combustion zone are caused to pass into said incandescent secondary combustion zone whereby to be consumed therein;

(f) said combustion chamber including opposed top and bottom ends, end walls connecting said top and bottom ends, and side walls connecting said end walls, said side walls being spaced apart and the outlet from said combustion chamber constituting a slot in one of said side walls, a cluster of vertically arranged water tubes mounted within said combustion chamber and extending between opposite ends thereof and spaced from the associated wall thereof to provide an air space between one of said side walls and said cluster of water tubes, a second cluster of water tubes mounted within said combustion chamber adjacent the opposite side wall and terminating adjacent said outlet slot therein, a third cluster of water tubes mounted within said combustion chamber in a vertical series adjacent the same wall as said second cluster in water tubes, but spaced below the outlet slot and spaced from the associated side wall of the combustion chamber, said water tubes in each of said first, second and third clusters being spaced apart whereby air may be injected into said combustion chamber between said water tubes; and (g) means in said housing for admitting air into the spaces between said housing walls and said water tubes whereby to provide air within said combustion chamber to support combustion of said mass of fuel therein.

12. The combination according to claim 11, in which means are provided associated with said second and third clusters of water tubes adjacent said outlet slot to control the volume of air entering the combustion chamber and said secondary combustion zone.

13. The combination according to claim 12, in which means are provided for circulating cooling water through said clusters of water tubes within said combustion chamber, and said means cooperatively related with said secondary combustion zone adapted to increase the temperature within said secondary combustion zone to incandescence includes valve means for supplying secondary air directly and proximately to said secondary combustion zone.

14. The combination according to claim 11, in which said second cluster of water tubes includes a multiplicity of parallel tubes extending between the end walls of said combustion chamber and parallel to the associated side wall thereof, the uppermost one of said water tubes being contiguous to said associated side wall, while the lowermost tube of said cluster is spaced inwardly from said associated side wall, and means including an elongated water tube disposed between the lowermost water tube of said second cluster and the side wall of the combustion chamber next adjacent said outlet slot whereby said lowermost tubes of the second cluster define one limit of said outlet, and said mass of combustible fuel is adapted to be disposed in said combustion chamber to a level above said outlet slot.

15. In a furnace adapted to be fired by combustible fuel fed into the furnace from a source of such fuel outside said furnace and equipped with an outlet from said furnace for products of combustion, said furnace having both a primary combustion zone and a secondary combustion zone defined therewithin, the method of operating said furnace to preclude the emission of pollutants comprising the steps of:

(a) charging said primary combustion zone with a mass of combustible fuel and igniting said fuel to fire said furnace and generate products of combustion from said mass of fuel;

(b) creating within said combustion chamber above said primary combustion zone a gasification zone having an ambient pressure less than atmospheric pressure;

(c) causing said products of combustion after release from said mass of combustible fuel to initially pass into said gasification zone of lower than atmospheric pressure and to then reenter said mass of combustible fuel and pass therethrough to reach and be admitted into said secondary combustion zone;

(d) elevating the temperature of said secondary combustion zone to incandescence whereby said products of combustion admitted into said secondary combustion zone are consumed therein; and (e) thereafter drawing whatever products of combustion remain through said secondary combustion zone to effect a more complete combustion of the products of combustion and then discharging products of combustion not consumed from said furnace.

16. The method according to claim 15, in which said secondary combustion zone is elevated to incandescent temperature by the admission of secondary combustion air into said secondary combustion zone.

17. The method according to claim 15, wherein said combustion chamber is charged with combustible fuel above and below said outlet from said furnace for products of combustion, causing primary combustion air to be admitted into said mass of combustible fuel above and below said outlet for products of combustion, causing secondary combustion air to be admitted into said mass of combustible fuel spanning said outlet for products of combustion whereby to convert the space occupied by said mass of combustible fuel spanning said outlet into a filter zone occupied by combustible fuel raised to incandescense.

18. The method according to claim 17, wherein primary combustion air is caused to enter said combustion chamber above and below where said secondary combustion zone air is caused to enter said mass of fuel spanning said outlet.

19. The method according to claim 17, wherein the ash pile resulting from combustion of said mass of combustible fuel is allowed to build up to a height within said combustion chamber above where primary combustion air is admitted to said combustion chamber below said outlet.

20. The method according to claim 17, wherein the ash pile resulting from combustion of said mass of combustible fuel is allowed to build up to a height within said combustion chamber above where secondary combustion air is admitted to said combustion chamber below said outlet.

21. The method according to claim 17, wherein the ash pile resulting from combustion of said mass of combustible fuel is allowed to build up to a height within said combustion chamber roughly level with said outlet from said combustion chamber for products of combustion.

22. The method according to claim 17, wherein said secondary combustion air is caused to be admitted to the interior of said combustion chamber and said mass of combustible fuel above and below said outlet for products of combustion.

* * * * *